US005413889A

United States Patent [19]

Sacripante et al.

[11] Patent Number: 5,413,889

[45] Date of Patent: May 9, 1995

[54] TONERS CONTAINING PIGMENT AND POLYAMIDE RESIN BINDERS

[75] Inventors: Guerino G. Sacripante, Oakville; B. W. Anissa Yeung, Mississauga, both of Canada

[73] Assignee: Xerox Corporation, Stamford, Conn.

[21] Appl. No.: 144,956

[22] Filed: Oct. 28, 1993

[51] Int. Cl.[6] ..... G03G 9/087

[52] U.S. Cl. ..... 430/106; 430/109; 430/110

[58] Field of Search ..... 430/106, 106.6, 110, 430/111, 109

[56] References Cited

U.S. PATENT DOCUMENTS

| | | | |
|---|---|---|---|
| 4,513,074 | 4/1985 | Nash et al. | 430/106.6 |
| 4,520,090 | 5/1985 | Yamazaki et al. | 430/106.6 |
| 4,543,313 | 9/1985 | Mahabadi et al. | 430/109 |
| 4,560,635 | 12/1985 | Hoffend et al. | 430/106.6 |
| 5,238,768 | 8/1993 | Ong | 430/110 |

OTHER PUBLICATIONS

Encyclopedia of Polymer Science and Engineering, vol. 12, 2nd Edition, published by Wiley, (1985) pp. 364 to 383.

*Primary Examiner*—John Goodrow
*Attorney, Agent, or Firm*—E. O. Palazzo

[57] ABSTRACT

A toner composition comprised of pigment, and polyimide of the formula

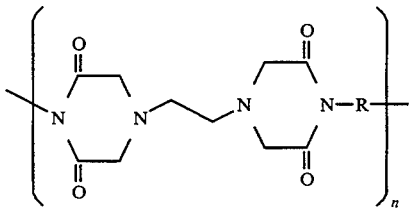

wherein n represents the number of monomer segments, and is a number of from about 10 to about 1,000; and R is alkyl, oxyalkyl, or polyoxyalkyl.

21 Claims, No Drawings

TONERS CONTAINING PIGMENT AND POLYAMIDE RESIN BINDERS

BACKGROUND OF THE INVENTION

This invention is generally directed to toner and developer compositions, and more specifically, the present invention is directed to developer and toner compositions containing novel polyimide resins, and process for the preparation thereof. In embodiments, there are provided in accordance with the present invention, low cost, and rapid jetting toner compositions comprised of certain economical polyimide amine resins obtained, for example, by melt condensation processes, and pigment particles comprised of, for example, carbon black, magnetites, or mixtures thereof, cyan, magenta, yellow, blue, green, red, or brown components, or mixtures thereof thereby providing for the development and generation of black and/or colored images. In embodiments, there are provided in accordance with the present invention polyimide resins of the following formula

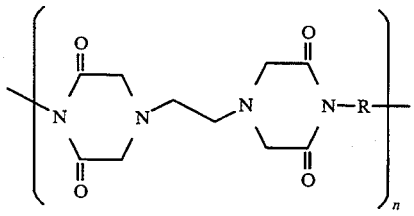

wherein n represents the number of repeating segments and can be a number of from about 10 to about 1,000; and R is an aliphatic component such as alkyl, oxyalkyl or polyoxyalkyl. The toner compositions of the present invention in embodiments possess a number of advantages including low materials cost, such as from about $0.75 to about $1.00 per pound as, for example, estimated from the *Chemical Marketing Reporter* (1993 issue), low fixing characteristics such as from about 125° C. to about 145° C., excellent blocking characteristics such as from about 55° C. to about 65° C., rapid jetting characteristics such as rates of from about 0.90 to about 2.2 relative, for example, to poly(propoxylated bisphenol A-fumarate) resin, excellent nonvinyl-offset properties, and low relative humidity sensitivities. The polyimides of the present invention can in embodiments be generated by the reaction of ethylene diamine tetracarboxylic acid, and a diamino terminated oxyalkyl or polyoxy alkyl, such as JEFFAMINES TM available from Texaco Chemicals as JEFFAMINE D-230 TM, D-400 TM, D-700 TM, EDR-148 TM, EDR-192 TM and believed to be of the following formula, or aliphatic diamines, like DYTEK TM.

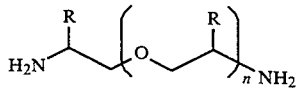

| wherein | |
|---|---|
| EDR-148 | n = 2; R = H |
| EDR-192 | n = 3; R = H |
| D-230 | n = 2 or 3; R = $CH_3$ |

-continued

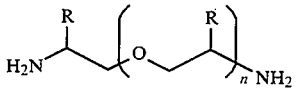

| wherein | |
|---|---|
| D-400 | n = 5 or 6; R = $CH_3$ |

The aforementioned polyimides exhibit in embodiments a number average molecular weight of from about 2,500 grams per mole to about 100,000 grams per mole as measured by vapor phase osmometry, have a glass transition temperature of from about 45° C. to about 65° C., and more preferably of from about 50° C. to about 65° C. as measured by the Differential Scanning Calorimeter, low fixing characteristics, such as from about 125° C. to about 145° C., and rapid jetting characteristics, such as rates of from about 0.90 to about 2.2 relative to poly(propoxylated bisphenol A) toner resins, and a $M_w$ of from about 1,500 to about 20,000.

In reprographic technologies, such as xerographic and ionographic devices, toners with small average volume diameter particle sizes of from about 11 microns to about 20 microns are usually utilized. Moreover, in some xerographic technologies, such as the high volume Xerox Corporation 5090 printers, high resolution characteristics and low image noise are highly desired, and can be attained utilizing small sized toners with average volume particle of less than 11 microns and preferably less than about 7 microns, and with a narrow geometric size distribution of less than about 1.4 and preferably of about 1.3 reported as the square root of the 84 percent volume particle size divided by the 15 percent volume particle size. Numerous processes are known for the preparation of toners, such as for example conventional processes wherein a resin is melt kneaded or extruded with a pigment, micronized and pulverized to provide toner particles with an average volume particle diameter of from about 7 microns to about 20 microns, and with geometric size distribution of from about 1.4 to about 1.7, followed by classification such that the geometric size distribution is reduced to from about 1.3 to about 1.42. Numerous pulverization processes are also known to reduce the particle size of toners to under 11 microns and preferably from 3 to 7 microns in average volume diameter. During the pulverization of jetted toners to less than about 11 microns, the geometric size distribution attained is from about 1.4 to about 1.7, and classification methods must be utilized to reduce the geometric distribution to less than 1.4. During classification processes, the amount of toner fines discarded is from about 30 to about 55 percent by weight of toner. To avoid or minimize the loss of toner fines, it is necessary to utilize toners comprised of base resins wherein rapid jetting can be selected. Rapid jetting can be quantified by relating toner resin jetting rates. One resin chosen for such quantification comparison is poly(propoxylated bisphenol A) with an average molecular weight of from about 10,000 to about 12,000 as measured by gel permeation chromatography and with a glass transition temperature of from about 53° C. to about 55° C. as measured by differential scanning calorimetry. It has been observed that in certain situations poly(propoxylated bisphenol A-fumarate) resin can be pulverized to about 5 microns in average volume diameter size with a low loss of resin fines, such as less than about 15 percent by weight or, more specifically, about 10 percent after classification. The relative jetting rate of a resin, such as the polyimide of the present invention (A), can then be measured by pulverizing it to a specified average volume diameter size, such as about 5 microns, by controlling the feed rate of the resin into the pulverizing chamber. This feeding rate is then compared to the feed rate utilized in pulverizing the poly(-propoxylated bisphenol A-fumarate) resin (B) to the same specified average volume diameter size such as about 5 microns. The relative jetting rate of a resin (A) is then given by the ratio of the feed rates;

R.R.=Feed rate of (A), Feed rate of (B)

wherein,

R.R. is the relative jetting rate of the resin (A);

(A) is the resin to be measured;

(B) is comparative resin poly(propoxylated bisphenol A).

It is observed that resins with a relative jetting rate of 0.75 or below are usually considered to be slow jetting, and results in high loss of fines such as from about 35 percent to about 55 percent by weight when pulverized to about 7 microns in volume average diameter. Resins with relative jetting rates of 1.0 are considered as acceptable jetting resins, and result in low loss of fines, such as from about 10 percent to about 15 percent by weight when pulverized to about 7 microns. Resins with rapid relative jetting rates of 2.0 or higher are considered to be excellent, and result in low loss of fines, such as about 9 percent by weight when pulverized to about 7 microns.

A number of toner resins are known, such as styrene acrylates, styrene methacrylates, styrene butadiene, polyesters, polyamides, and the like.

Certain polyimide resins and, more specifically, liquid crystalline polyimide resins are known such as summarized and illustrated in the *Encyclopedia of Polymer Science and Engineering,* 2nd Edition, Volume No. 12, published by Wiley (1985). However, such polyimide resins are aromatic and useful as high performance materials, there being no disclosure for use as toners.

Thermotropic liquid crystalline polyimides are illustrated in U.S. Pat. No. 5,348,930, filed concurrently herewith, the disclosure of which is wholly incorporated herein by reference, which discloses toner and developer compositions with thermotropic liquid crystalline polyimides. The polyimide resins of this invention differ in that, for example, they do not exhibit liquid crystalline properties, and moreover are of substantially lower cost such as from about 80 percent to about 500 percent less than the liquid crystalline polyimides of U.S. Pat. No. 5,348,930 as estimated, for example, from the *Chemical Marketing Reporter* (1993 issue). Also, the imide structures of the resins of the present invention are comprised of a cyclic six membered ring containing a tertiary alkyl amine as contrasted to the aforementioned liquid crystalline polyimides of U.S. Pat. No. 3,348,930, wherein the imide structure is comprised of a five membered cyclic ring without a tertiary alkyl amine moiety.

Illustrated in the following copending applications, the disclosures of each being totally incorporated herein by reference, are:

U.S. Ser. No. 144,075, filed concurrently herewith, illustrates a toner composition comprised of a pigment and a crosslinked polyimide; and wherein the crosslinked polyimide can be obtained from the reaction of a peroxide with an unsaturated polyimide of the formula

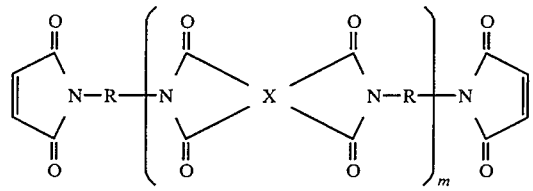

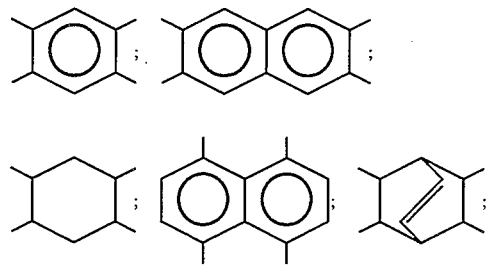

or

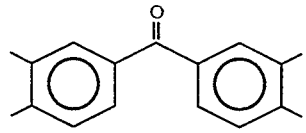

R is alkyl or oxyalkylene and m represents the number of monomer segments present and is a number of from about 10 to about about 1,000.

U.S. Pat. No. 5,348,831, illustrates a toner composition comprised of pigment, and a polyester imide resin of the formula

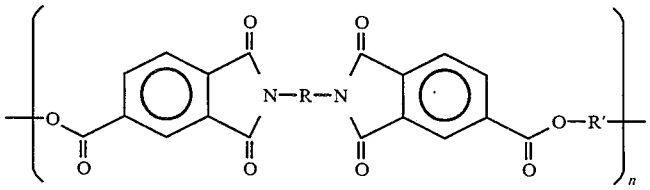

wherein n represent the number of segments present and is a number of from about 10 to about 10,000; R′ is alkyl or alkylene; and R is independently selected from the group consisting of an oxyalkylene and polyoxyalkylene.

U.S. Ser. No. 144,918, filed concurrently herewith, illustrates a toner composition comprised of pigment, and polyimide of the formula

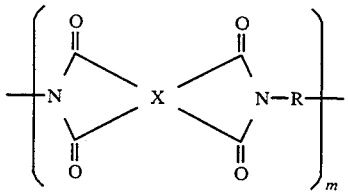

wherein m, represent the number of monomer segments present; X is

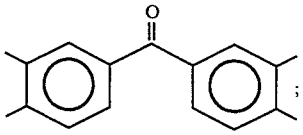

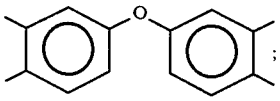

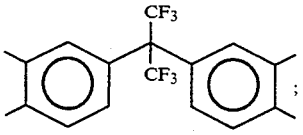

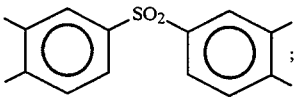

or

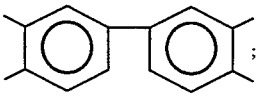

thus X can be benzophenone, oxydiphthalic, hexafluoropropane diphenyl, diphenyl sulfone, or biphenyl; and X is attached to four imide carbonyl moieties; and R is independently selected from the group consisting of alkyl, oxyalkylene and polyoxyalkylene.

SUMMARY OF THE INVENTION

It is an object of the present invention to provide toner and developer compositions with many of the advantages illustrated herein.

In another object of the present invention there are provided toner compositions with certain polyimides, and which toners are useful for the development of electrostatic latent images including color images.

In yet another object of the present invention there are provided processes for the preparation of certain polyimides by melt condensation methods.

Moreover, in another object of the present invention that are provided low melting toner compositions with rapid jetting rates, and wherein such toners avoid or minimize paper curl and enable high resolution developed images.

In another object of the present invention there are provided toners with low melt fusing temperatures of from about 130° C. to about 145° C. and a broad fusing latitude of from about 30° C. to about 60° C.

Moreover, in another object of the present invention there are provided toner compositions comprised of polyimides with glass transition temperature of from about 50° C. to about 65° C.

In yet another object of the present invention that are provided toner compositions comprised of polyimides with a weight average molecular weight of from about 1,500 grams per mole to about 100,000 gram per mole as measured by GPC.

Moreover, it is an object of the present invention to provide toners which display high gloss such as from about 30 to about 60 gloss units as measured by the Gardner Gloss metering unit, and excellent crease characteristics.

Moreover, it is an object of the present invention to provide a toner which displays low relative sensitivity such as from about 1.0 to about 2.3 as measured from the triboelectric charge ratio at the 20 percent humidity level and 80 percent humidity level.

Another object of the present invention resides in the formation of toners which will enable the development of images in electrophotographic imaging and printing apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

Also, in another object of the present invention there are provided polyimide resins with rapid jetting properties such as relative jetting rates of from about 1.0 to about 4.0, and preferably from about 1.2 to about 2.0.

These and other objects of the present invention can be accomplished in embodiments thereof by providing toner compositions comprised of polyimides of the formula illustrated herein, and pigment particles.

The polyimide resins of the present invention can be prepared as illustrated herein, and more specifically, by charging a reactor equipped with a bottom drain valve, double turbine agitator and distillation receiver with a cold water condenser with from about 0.95 to about 1.05 mole of ethylenediamine tetracetic acid, or ethylenediamine tetracetic dianhydride, and 0.95 to about 1.05 mole of a flexible diamine, such as a diamino terminated polyoxypropylene available as JEFFAMINE 230 TM from Texaco Chemicals. The reactor is then heated to about 150° C. to about 170° C. with stirring for a duration of from about 3 hours whereby 0.5 to about 0.9 mole of water byproduct is collected in the distillation receiver. The mixture is then heated at from about 180° C. to about 210° C., after which the pressure is slowly reduced from atmospheric pressure to about 300 Torr, over a period of from about one hour to about 5 hours with collection of approximately 0.1 to about 0.3 mole of water in the distillation receiver, and wherein the total amount of water collected from the beginning of the reaction is from about 0.95 to about 1.0 mole equivalent. The reactor is then purged with nitrogen to atmospheric pressure, and the resulting product, such as poly(oxypropylene-ethylenediamine tetracidic-d), is collected through the bottom drain valve. The glass transition temperature of the resin can then be measured and in embodiments is from about 45° C. to about 65° C. (onset) utilizing the 910 Differential Scanning Calorimeter available from E. I. DuPont operating at a heating rate of 10° C. per minute. The number average molecular weight can be measured and in embodiments is from about 1,500 grams per mole to about 20,000 grams per mole by vapor phase calorimetry.

In an embodiment, the polyimide resins of the present invention can be prepared by charging a vessel equipped with an agitator, with from about 0.95 to about 1.05 mole of ethylenediamine tetracetic acid, or ethylenediamine tetracetic dianhydride, and 0.95 to about 1.05 mole of a diamine, such as DYTEK A TM (2-methylpentane-diamine) available from E. I. DuPont or diamino terminated polyoxypropylenes available as JEFFAMINE EFR-148 TM from Texaco Chemicals, and a high boiling solvent such as a nomethyl pyrolidinone (NMP), from about 5 to about 50 moles. The vessel is then stirred from about 1 hour to about 16 hours, and heated to about 100° C. to about 130° C. with a stirring for a duration of from about one to about 5 hours. The mixture is then precipitated in about 1 to about 5 liters of acetone, and the polyimide product further purified by subjecting it to a soxhlet extraction apparatus with a solvent, such as acetone, after which the product resin is collected, and dried under vacuum of from about 100 to about 0.1 Torr for a duration of from about 0.5 hour to about 10 hours.

Specific examples of polyimide resins include poly(ethyleneethylenediamine-tetracetic diimide); poly(propylene-ethylenediamine-tetracetic diimide); poly(butylene-ethylenediamine-tetracetic diimide); poly(pentylene-ethylenediamine-tetracetic diimide); poly(2-methylpentylene-ethylenediamine-tetracetic diimide); poly(hexyleneethylenediamine-tetracetic diimide); poly(dodecyl-ethylenediaminetetracetic diimide); poly(oxyethylene-ethylenediamine-tetracetic diimide); poly(oxypropylene-ethylenediamine-tetracetic diimide); poly(dioxyethylene-ethylenediamine-tetracetic diimide); poly(dioxypropylene-ethylenediamine-tetracetic diimide); poly(trioxyethylene-ethylenediamine-tetracetic diimide); poly(trioxypropylene-ethylenediamine-tetracetic diimide); and copoly(oxypropylene)-copoly(ethylenediamine-tetracetic diimide).

Specific examples of tetraacid or dianhydride monomers that can be utilized to prepare the polyimide, including ethylenediamine tetracetic acid, ethylenediamine tetracetic dianhydride, tetramethyl ethylenediamine tetracetate, tetraethyl ethylenediamine tetracetate, tetrapropyl ethylenediamine tetracetate, tetrabutyl ethylenediamine tetracetate, tetrapentyl ethylenediamine tetracetate, (ethylenedinitrilo)tetracetic acid, 4,4'-ethylenebis(2,6-morpholinedione), and mixtures thereof. These monomers are selected in various effective amounts, such as from about 0.45 mole equivalent to about 0.55 mole equivalent.

Specific examples of diamino alkanes or diamino alkylene oxides that can be utilized to prepare the polyimides include diaminoethane, diaminopropane, 2,3-diaminopropane, diaminobutane, diaminopentane, diamino-2-methylpentane, also known as DYTEK A TM available from DuPont Chemical Company, diaminohexane, diamino-trimethylhexane, diaminoheptane, diaminooctane, diaminononane, diaminodecane, diaminododecane, diaminoterminated-ethylene oxide, diaminoterminated-diethylene oxide available as JEFFAMINE EDR-148 TM from Texaco Chemicals, diaminoterminated-diethylene oxide available as JEFFAMINE EDR-148 TM from Texaco Chemicals, diaminoterminated-triethylene oxide available as JEFFAMINE EDR-192 TM from Texaco Chemicals, diaminoterminated-polyoxypropylene oxide available from Texaco Chemicals as JEFFAMINE D-230 TM, JEFFAMINE 400 TM, JEFFAMINE 700 TM, mixtures thereof, and the like. This component is selected in various effective amounts such as from about 0.45 mole equivalent to about 0.55 mole equivalent of the polyimide resin.

Various known colorants present in the toner in an effective amount of, for example, from about 1 to about 25 percent by weight of toner, and preferably in an amount of from about 1 to about 10 weight percent, that can be selected include carbon black like REGAL 330® magnetites, such as Mobay magnetites MO8029 TM, MO8060 TM; Columbian magnetites; MAPICO BLACKS TM and surface treated magnetites; Pfizer magnetites, CB4799 TM, CB5300 TM, CB5600 TM, MCX6369 TM; Bayer magnetites, BAYFERROX 8600 TM, 8610 TM; Northern Pigments magnetites, NP-604 TM, NP-608 TM; Magnox magnetites TMB-100 TM, or TMB-104 TM; and other equivalent black pigments. As colored pigments there can be selected known cyan, magenta, yellow, red, green, brown, blue or mixtures thereof. Specific examples of pigments include HELIOGEN BLUE L6900 TM, D6840 TM, D7080 TM, D7020 TM, PYLAM OIL BLUE TM and PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM and cyan may also be selected as pigments, and are employed in effective amounts of from, for example, about 1 weight percent to about 50 weight percent of the toner.

The toner may also include known charge additives such as alkyl pyridinium halides, bisulfates, the charge control additives of U.S. Pat. Nos. 3,944,493; 4,007,293; 4,079,014; 4,394,430 and 4,560,635 which illustrates a toner with a distearyl dimethyl ammonium methyl sulfate charge additive, the disclosures of which are totally incorporated herein by reference, negative charge additives like aluminum complexes, such as BONTRON E-88 TM, available from Orient Chemicals, and the like.

Surface additives that can be added to the toner compositions of the present invention include, for example, metal salts, metal salts of fatty acids, colloidal silicas, tin oxides, titanium oxides, mixtures thereof and the like, which additives are usually present in an amount of from about 0.1 to about 1 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa Chemicals. Also, waxes, such as polyproylene and polyethylene, can be added to the toner in amounts of, for example, from about 0.1 to about 3 weight percent.

In another embodiment of the present invention there are provided, subsequent to known micronization and classification, toner with an average volume diameter of from about 5 to about 20 microns comprised of polyimide resin, and pigment particles, and optional charge enhancing additives.

The polyimide resin is present in a sufficient, but effective amount, for example from about 70 to about 95 weight percent. Thus, when 1 percent by weight of a charge enhancing additive is present, and 10 percent by weight of pigment or colorant, such as carbon black, is contained therein, about 89 percent by weight of resin is selected. Also, the charge enhancing additive may be coated on the pigment particles.

The toner and developer compositions of the present invention may be selected for use in electrostatographic imaging apparatuses containing therein known photoreceptors. Thus, the toner and developer compositions of the present invention can be used with layered photoreceptors, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

Developer compositions include carrier particles, and the polyimide toners illustrated herein, examples of carriers being steel, iron, ferrites, silicon oxides, and the like, reference for example U.S. Pat. Nos. 4,937,166 and 4,935,326, the disclosures of which are totally incorporated herein by reference.

The following examples are being provided to further define various species of the present invention, and these examples are intended to illustrate and not limit the scope of the present invention. Parts and percentages are by weight unless otherwise indicated.

EXAMPLE I

A polyimide resin derived from ethylenediamine tetracetic acid dianhydride and 2-methylpentyl diamine available as DYTEK A TM from DuPont Chemical Company was prepared as follows:

To a three necked flask equipped with a reflux condenser were added DYTEK A TM (4.5 grams, 0.039 mole), 78 milliliters of n-methyl pyrollidone (NMP) and ethylenediamine tetracetic dianhydride (10.0 grams, 0.039 mole). The resulting slurry was stirred at room temperature, about 25° C., overnight, about 18 hours, to provide a clear yellow solution. To this solution were then added NMP (78 milliliters), pyridine (90 milliliters) and acetic anhydride (180 milliliters), and the resulting solution was heated at 110° C. under Argon in an oil bath for 5 hours. The color of the solution changed from light yellow to dark brown during the heating. The dark brown solution was cooled down to room temperature and then precipitated with acetone to provide the polyimide. The polyimide was then digested in hot acetone (500 milliliters) for an hour, cooled to room temperature and filtered. The polyimide was then dried under vacuum at 60° C. overnight. The glass transition temperature of the resulting polyimide resin was measured using an E. I. DuPont Differential Scanning Calorimeter at 10° C. per minute, and found to be 67° C.

EXAMPLE II

A polyimide resin derived from ethylenediamine tetracetic acid dianhydride and 2-methylpentanediamine and terminated polyoxypropylene available as JEFFAMINE EDR-148 TM from Texaco Chemical Company was prepared as follows:

To a three necked flask equipped with a reflux condenser were added DYTEK A TM (42 grams, 0.36 mole), JEFFAMINE EDR-148 TM (4.5 grams, 0.03 mole) and 500 milliliters of n-methyl pyrollidone (NMP) and ethylenediamine tetracetic dianhydride (100.0 grams, 0.39 mole). The resulting slurry was stirred at room temperature overnight, about 20 hours, to provide a clear yellow solution. To this solution was then added NMP (200 milliliters), pyridine (90 milliliters) and acetic anhydride (180 milliliters), and the resulting solution was heated at 110° C. under Argon in an oil bath for 5 hours. The solution was then cooled down to room temperature and poured into 3 liters of acetone to provide the polyimide resin. The polyimide is then placed in a soxhlet extraction apparatus using acetone as the solvent. The polyimide is then collected and dried under vacuum at 60° C. overnight. The glass transition temperature of the obtained polyimide resin was then measured using an E. I. DuPont Differential Scanning Calorimeter at 10° C. per minute, and found to be 60° C.

EXAMPLE III

A polyimide resin derived from ethylenediamine tetracetic acid dianhydride and 2-methylpentanediamine and terminated polyoxypropylene available as JEFFAMINE EDR-148 TM from Texaco Chemical Company was prepared as follows:

To a three necked flask equipped with a reflux condenser were added DYTEK A TM (38 grams, 0.33 mole), JEFFAMINE EDR-148 TM (9 grams, 0.06 mole) and 500 milliliters of N-methyl pyrollidone (NMP) and ethylenediamine tetracetic dianhydride (100 grams, 0.39 mole). The resulting slurry was stirred at room temperature overnight, about 20 hours, to provide a clear yellow solution. To this solution was added NMP (200 milliliters), pyridine (90 milliliters) and acetic anhydride (180 milliliters), and the resulting solution was heated at 110° C. under Argon in an oil bath for 5 hours. The polyimide was then precipitated with acetone and placed in a soxhlet extraction apparatus using acetone as the solvent. The polyimide was then collected and dried under vacuum at 60° C. overnight. The glass transition temperature of the resulting polyimide resin was then measured using an E. I. DuPont Differential Scanning Calorimeter at 10° C. per minute, and found to be 56° C.

EXAMPLE IV

A polyimide resin derived from ethylenediamine tetracetic acid dianhydride and 2-methylpentanediamine and terminated polyoxypropylene available as JEFFAMINE EDR-192 TM from Texaco Chemical Company was prepared as follows:

To a three necked flask equipped with a reflux condenser were added DYTEK A TM (42 grams, 0.36 mole), JEFFAMINE EDR-192 TM (6 grams, 0.03 mole) and 500 milliliters of n-methyl pyrollidone (NMP) and ethylenediamine tetracetic dianhydride (100 grams, 0.39 mole). The resulting slurry was stirred at room temperature overnight, about 21 hours, to provide a clear yellow solution. To this solution were then added NMP (500 milliliters), pyridine (90 milliliters) and acetic anhydride (180 milliliters), and the resulting solution was heated at 110° C. under Argon in an oil bath for 5 hours. The polyimide was then precipitated with acetone and placed in a soxhlet extraction apparatus using acetone as the solvent. The resulting polyimide was then collected and dried under vacuum at 60° C. overnight. The glass transition temperature of the obtained resin was then measured using an E. I. DuPont Differential Scanning Calorimeter at 10° C. per minute, and found to be 53° C.

EXAMPLE V

A polyimide resin derived from ethylenediamine tetracetic acid dianhydride and 2-methylpentanediamine, and terminated polyoxypropylene available as JEFFAMINE D-240 TM from Texaco Chemical Company was prepared as follows:

To a three necked flask equipped with a reflux condenser were added DYTEK A TM (42 grams, 0.36 mole), JEFFAMINE D-240 TM (7.2 grams, 0.03 mole) and 500 milliliters of N-methyl pyrollidone (NMP) and ethylenediamine tetracetic dianhydride (100 grams, 0.39 mole). The resulting slurry was stirred at room temperature overnight, about 21 hours, to provide a clear yellow solution. To this solution were then added NMP (500 milliliters), pyridine (90 milliliters) and acetic anhydride (180 milliliters), and the resulting solution was heated at 110° C. under Argon in an oil bath for 5 hours. The polyimide was then precipitated with acetone and placed in a soxhlet extraction apparatus using acetone as the solvent. The polyimide was then collected and dried under vacuum at 60° C. overnight. The glass transition temperature of the obtained resin was then measured using the Dupont Differential Scanning Calorimeter at 10° C. per minute, and found to be 51° C.

EXAMPLE VI

A toner composition comprised of 94 percent by weight of the polyimide of Example II, and 6 percent by weight of REGAL 330 ® black pigment was prepared as follows.

The polyimide of Example II was in the form of a large chunk. The resulting polymer was ground to smaller particles using a Black and Decker coffee bean grinder. After grinding, 94 grams (94 percent by weight of toner) of the polyimide of Example II were mixed with 6 grams of REGAL 330 ® pigment (6 percent by weight of toner). The two components were dry blended on a roll mill. A HAAKE melt mixer was then used to melt mix the aforementioned mixture at a temperature of 140° C. The mixture was then removed, cooled to ambient temperature and ground to smaller particles using a Black and Decker coffee bean grinder. An 8 inch Sturtevant micronizer was used to reduce the particle size further. After grinding, the toner was measured to display an average volume diameter particle size of 7.2 microns with a geometric distribution of 1.37 as measured by a Coulter Counter. A developer composition was prepared by roll milling the aforementioned toner, 3 parts by weight with 100 parts by weight of carrier, about 90 microns in diameter, comprised of a steel core with polyvinylidene polymer coating, 0.175 weight percent thereof. The aforementioned developer was incorporated into a 20 percent humidity chamber for 24 hours, and the triboelectric charge was measured by the known blow-off Faraday Cage apparatus, followed by subjecting the developer in an 80 percent humidity chamber for 24 hours. The relative humidity sensitivity of this toner was then calculated as the ratio of the charges obtained in the 20 percent and 80 percent humidity chamber, and found to be 2.15. It is believed that unfused copies can be produced with the above toner using a Xerox Corporation 1075 imaging apparatus and subsequently fusing to result in excellent fixed images without ghosting or background.

EXAMPLE VII

A toner composition comprised of 94 percent by weight of the polyimide of Example III, and 6 percent by weight of REGAL 330 ® black pigment was prepared as follows.

The polyimide of Example III was in the form of a large chunk. The resulting polymer was ground to smaller particles using a Black and Decker coffee bean grinder. After grinding, 94 grams (94 percent by weight of toner) of the polymer polyimide Example III were mixed with 6 grams of REGAL 330 ® pigment (6 percent by weight of toner). The two components were dry blended on a roll mill. A HAAKE melt mixer was then used to melt mix the aforementioned mixture at a temperature of 140° C. The mixture was then removed, cooled to ambient temperature and ground to smaller particles using a Black and Decker coffee bean grinder. An 8 inch Sturtevant micronizer was used to reduce the particle size further. After grinding, the toner was measured to display an average volume diameter particle size of 7.0 microns with a geometric distribution of 1.36 as measured by the Coulter Counter. A developer composition was prepared by roll milling the aforementioned toner, 3 parts by weight with 100 parts by weight of carrier, about 90 microns in diameter, comprised of a steel core with polyvinylidene polymer coating, 0.175 weight percent thereof. The aforementioned developer was incorporated into a 20 percent humidity chamber for 24 hours, followed by measuring the charge by the known blow-off Faraday Cage apparatus, followed by incorporating the developer in an 80 percent humidity chamber for 24 hours, and then measuring the tribocharge. The relative humidity sensitivity of this toner was then calculated as the ratio of the charges obtained in the 20 percent and 80 percent humidity chamber, and found to be 1.9. It is believed that unfused copies can be produced with the above toner using a Xerox Corporation 1075 imaging apparatus and subsequently fused to result in excellent fixed images without ghosting or background.

Other modifications of the present invention may occur to those skilled in the art subsequent to a review of the present application and these modifications, including equivalents thereof, are intended to be included within the scope of the present invention.

What is claimed is:

1. A toner composition comprised of pigment, and polyimide of the formula

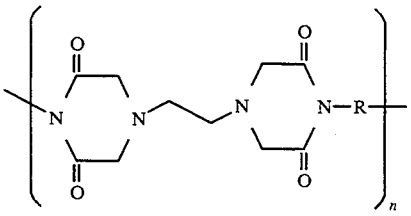

wherein n represents the number of monomer segments, and is a number of from about 10 to about 1,000; and R is alkylene, oxyalkylene, or polyoxyalkylene.

2. A toner in accordance with claim 1 wherein R is alkyl with from 1 to about 25 carbon atoms.

3. A toner in accordance with claim 1 wherein R is methylene, ethylene, propylene, butylene, pentylene, hexylene, heptylene, octylene, nonylene, decylene, undecylene, dodecylene, stearylene, laurylene, or mixtures thereof.

4. A toner in accordance with claim 1 wherein R is an oxyalkylene selected from the group consisting of diethyleneoxide, dipropyleneoxide, triethyleneoxide, polypropyleneoxide, and mixtures thereof.

5. A toner in accordance with claim 1 wherein the polyimide resin is selected from the group consisting of poly(ethyleneethylenediaminetetracetic diimide); poly(propylene-ethylenediaminetetracetic diimide); poly(butylene-ethylenediaminetetracetic diimide); poly(pentylene-ethylenediamine-tetracetic diimide); poly(2-methylpentylene-ethylenediamine-tetracetic diimide); poly(hexylene-ethylenediamine-tetracetic diimide); poly(dodecyl-ethylenediaminetetracetic diimide); poly(oxyethylene-ethylenediamine-tetracetic diimide); poly(oxypropylene-ethylenediamine-tetracetic diimide); poly(dioxyethylene-ethylenediamine-tetracetic diimide); poly(dioxypropylene-ethylenediamine-tetracetic diimide); poly(trioxyethylene-ethylenediamine-tetracetic diimide); poly(trioxypropylene-ethylenediamine-tetracetic diimide); copoly(oxypropylene)-copoly(ethylenediamine-tetracetic diimide); and mixtures thereof.

6. A toner in accordance with claim 1 wherein the polyimide has a $M_n$ of from about 1,500 to about 20,000, and an $M_w$ of from about 2,500 to about 100,000.

7. A toner in accordance with claim 1 which possesses a low fixing temperature of from about 120° C. to about 145° C. and a broad fusing latitude of from about 40° C. to about 120° C.

8. A toner in accordance with claim 1 wherein the polyimide is obtained from the reaction of from about 0.40 mole equivalent to about 0.55 mole equivalent of an acid dianhydride, and from about 0.40 mole equivalent to about 0.55 mole equivalent of a diamine.

9. A toner in accordance with claim 8 wherein the acid dianhydride is selected from the group consisting of ethylenediamine tetracetic acid, ethylenediamine tetracetic dianhydride, tetramethyl ethylenediamine tetracetate, tetraethyl ethylenediamine-tetracetate, tetrapropyl ethylenediamine tetracetate, tetrabutyl ethylenediamine tetracetate, tetrapentyl ethylenediamine tetracetate, (ethylenedinitrilo)tetracetic acid, 4,4'-ethylenebis(2,6-morpholinedione), and mixtures thereof.

10. A toner in accordance with claim 8 wherein the diamine is selected from the group consisting of diaminoethane, diaminopropane, 2,3-diaminopropane, diaminobutane, diaminopentane, diamino-2methylpentane (DYTEK A TM) diaminohexane, diamino-trimethylhexane, diaminoheptane, diaminooctane, diaminononane, diaminodecane, diaminododecane, diaminoterminated diethyleneoxide, diaminoterminated triethyleneoxide, and a polyoxyalkylene of the formula

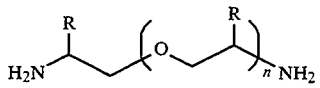

wherein R represents a hydrogen or alkyl group, and n represents monomer segments and is a number of from about 1 to about 10.

11. A toner composition in accordance with claim 1 with a glass transition temperature thereof of from about 50° C. to about 65° C.

12. A toner composition in accordance with claim 1 with a relative humidity sensitivity of from about 1.01 to about 2.3.

13. A toner composition in accordance with claim 1 further including a charge enhancing additive incorporated into the toner, or present on the surface of the toner.

14. A toner composition in accordance with claim 1 further containing a wax component with a weight average molecular weight of from about 1,000 to about 10,000.

15. A toner composition in accordance with claim 1 further containing as external additives metal salts of a fatty acid, colloidal silicas, or mixtures thereof.

16. A toner composition in accordance with claim 1 wherein the pigment is carbon black, magnetites, or mixtures thereof, cyan, magenta, yellow, red, blue, green, brown, or mixtures thereof.

17. A developer composition comprised of pigment, and polyimide of the formula

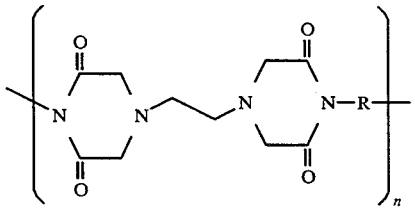

wherein n represents the number of monomer segments, and is a number of from about 10 to about 1,000; and R is alkylene, oxyalkylene, or polyoxyalkylene and carrier particles.

18. A developer composition in accordance with claim 17 wherein the carrier particles are comprised of ferrites, steel, or an iron powder with an optional coating, or mixture of coatings.

19. A method of imaging which comprises formulating an electrostatic latent image on a photoconductive imaging member, affecting development thereof with the toner composition of claim 1, and thereafter transferring the developed image to a suitable substrate.

20. A toner composition consisting essentially of pigment, and polyimide of the formula

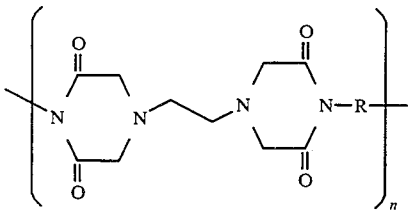

wherein n represents the number of monomer segments, and is a number of from about 10 to about 1,000; and R is alkylene, oxyalkylene, or polyoxyalkylene.

21. A toner composition in accordance with claim 20 wherein the polyamide resin is selected from the group consisting of poly(ethylene-ethylenediamine-tetracetic diimide); poly(propylene-ethylenediaminetetracetic diimide); poly(butylene-ethylenediaminetetracetic diimide); poly(pentylene-ethylenediamine-tetracetic diimide); poly(2-methylpentylene-ethylenediamine-tetracetic diimide); poly(hexylene-ethylenediamine-tetracetic diimide); poly(dodecyl-ethylenediaminetetracetic diimide); poly(oxyethylene-ethylenediamine-tetracetic diimide); poly(oxypropylene-ethylenediamine-tetracetic diimide); poly(dioxyethylene-ethylenediamine-tetracetic diimide); poly(dioxypropylene-ethylenediamine-tetracetic diimide); poly(trioxyethylene-ethylenediamine-tetracetic diimide); poly(trioxypropylene-ethylenediamine-tetracetic diimide); and copoly(oxypropylene)-copoly(ethylenediamine-tetracetic diimide).

* * * * *